United States Patent [19]

Mourier

[11] 4,034,258

[45] July 5, 1977

[54] DEVICE FOR ATTENUATING VERY SHORT PARASITIC WAVES IN ELECTRONIC TUBES

[75] Inventor: Georges Mourier, Paris, France

[73] Assignee: Thomson-CSF, Paris Cedex, France

[22] Filed: June 24, 1975

[21] Appl. No.: 589,888

[30] Foreign Application Priority Data

June 28, 1974 France ..... 74.22688

[52] U.S. Cl. ..... 315/39; 315/39.51; 333/81 R; 333/81 A

[51] Int. Cl.[2] ..... H01J 7/46; H01J 19/80

[58] Field of Search ..... 315/39, 39.51; 333/81 R, 81 A

[56] References Cited

UNITED STATES PATENTS

| | | | |
|---|---|---|---|
| 2,643,297 | 6/1953 | Goldstein et al. | 333/81 A |
| 2,667,622 | 1/1954 | Weber et al. | 333/81 A |
| 2,895,117 | 7/1959 | Schramp | 333/81 A X |
| 3,005,967 | 10/1961 | Weinschel et al. | 333/81 A |
| 3,223,881 | 12/1965 | Krug, Jr. | 315/39 |

*Primary Examiner*—Saxfield Chatmon, Jr
*Attorney, Agent, or Firm*—Roland Plottel

[57] ABSTRACT

This device essentially comprises a resistive element connected between two conductor elements one of which is attached to one of the two walls between which the waves requiring attenuation appear, and the other of which is located opposite the other wall, constituting a capacitor in relation thereto; such devices are disposed in regions of high frequency tubes such as magnetrons or tetrodes devoided of useful waves.

9 Claims, 4 Drawing Figures

DEVICE FOR ATTENUATING VERY SHORT PARASITIC WAVES IN ELECTRONIC TUBES

The present invention relates to a device which makes it possible to attenuate very short waves of the kind occurring as parasitics in high frequency circuits, such as parts of electronic tubes.

It is well known to damp parasitic oscillations developing in electronic tubes, for example by introducing into the relevant part of the tube highly damped oscillatory circuits or again by arranging such circuits in the tube load circuits. Circuits of this kind have several drawbacks however. In particular, their operating band-width is narrow since they are resonant circuits; this requires the use of several different oscillatory circuits if several different parasitic resonances are occuring, something which is expensive and often impossible indeed, in view of the small amount of space available within electronic tubes. They increase the number of resonances, too, and this is undesirable.

The attenuator devices in accordance with the present invention are absorber devices having no resonance in the operating band of the high frequency circuits to which they are fitted. They are therefore capable of damping parasitic waves of different frequencies.

Devices of this kind, being capable of absorbing electromagnetic waves throughout virtually the whole of the operating band-width of the high frequency tubes to which they are fitted, must, of course, be disposed in said tubes in such a fashion as to absorb only the parasitic waves without attenuating the useful wafes of these tubes.

According to the invention, there is provided a device for attenuating very short parasitic waves occurring between two conductive walls of a high frequency electronic tube, comprising a resistive element connected between two conducting components, one of said two conducting components being connected to one of said two conductive walls and the other is located opposite the other of said walls and forms a capacitor in association therewith, said attenuator device being disposed between said two conductive walls in a region of said tube devoided of useful waves (when said tube is operating).

The invention, as well as illustrative embodiments, will now be described, reference being directed to the accompanying drawings in which.

Figure 1:
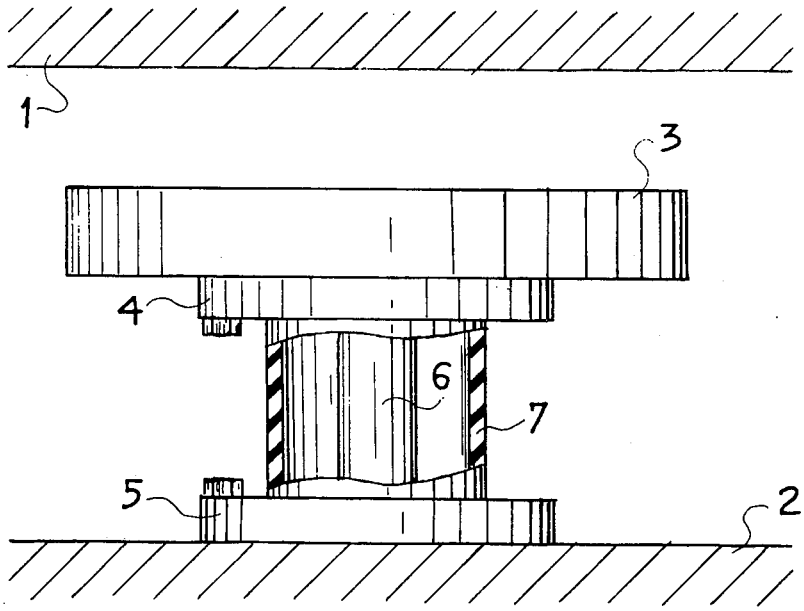
FIG. 1 is a schematic partially sectioned view of an attenuator device in accordance with the invention arranged between two walls between which parasitic waves are developed.

FIG. 1 illustrates an attenuator device in accordance with the invention connected in part of a high frequency circuit constituted by two conductive walls 1 and 2 located opposite each other and being part of a high frequency electronic tube, high frequency parasitic waves requiring elimination being responsible for the development between said two walls of a high frequency electric field whose lines of force are perpendicular to the two walls 1 and 2.

The device in accordance with the invention, which will now be described, essentially consists of a circuit made up of a resistor in series with a capacitor, between the walls 1 and 2. The high frequency electric field present between the walls 1 and 2 develops in said circuit a high frequency current which dissipates power in the resistor. The high frequency waves corresponding to said field are therefore attenuated.

The device comprises a resistive element formed by a resistive body 6 fixed, for example by a brazing operation, between two metal components 4 and 5.

The metal component 5 is attached to the wall 2; a capacitive electrode 3 is attached to the metal component 4, said capacitive electrode 3 is spaced from wall 1 and forms capacitor $C_1$ with wall 1. It should be noted that the component 4 and the electrode 3 could be constituted by one and the same element.

The electrical circuit thus established between the walls 1 and 2 comprises the capacitor $C_1$ delimited by the wall 1 and capacitive electrode 3, said capacitor being connected in series with the resistor R constituted by the body 6. It should be noted, furthermore, that a capacitor $C_2$ whose electrodes are the mutually opposite parts of the components 3, 4 and 5, 2, is connected in parallel with the resistor 6.

In order for the electric field present between the walls 1 and 2 to be properly damped, it is necesssary that the current flowing through the resistive body 6 should be as high as possible. To achieve this result, it is necessary on the one hand that the impedance of the capacitor $C_1$ should be quite low and on the other that of the capacitor $C_2$ should be fairly high, compared with the resistance of the resistor R.

The capacitance of the capacitor $C_1$ is determined by the dimensions of the electrode 3 and by the distance between said electrode 3 and the wall 1.

To ensure that the capacitor $C_2$ does not have too low an impedance compared with the resistor R so that the absorbtive effect is reduced, the element 6 is made of a material which does not have too high a resistivity; it may for example be a porous dielectric filled with conductive or semi-conductive substances, a doped semi-conductive substance, etc. etc.

A gastight insulating sheath 7 is attached to the components 4 and 5 by a brazing or welding operation for example, in order to physically completely isolate the resistive body 6 from the enclosure of the tube in which it is assembled.

In effect, the body 6 is highly heated by the thermal energy which it dissipates, and the majority of the materials having the appropriate resistance to constitute said body 6, porous dielectrics filled with conductive substances in particular, liberate relatively large quantities of gas when they are heated. It is obviously undesirable that these gases should spread through interior of the tube to which such attenuator devices are fitted; the sheath 7 prevents this phenomenon from occurring, by localising the gases around the body 6.

It should be noted that if the body 6 is made of a porous dielectric filled with semi-conductive substances, it does not liberate gas during heating and the sheath 6 is then unnecessary. However, this technology has another drawback. In other words, since the resistivity of a semi-conductive material varies with temperature, the parasitic microwave absorption depends upon the temperature.

The attenuator devices of the kind described in relation to FIG. 1, in addition to the major advantage that they are efficient within a wide frequency band since they are not resonant in nature and that their technology is simple, possess a certain number of other advantages.

The dissipation of the heat developed in the resistive body 6 is conveniently effected to the wall 2 through the metal component 5 which provides a good thermal contact between the body 6 and the wall 2.

The capacitive electrical connection effected by the electrode 3 opposite the wall 1, has several advantages.

In other words, in addition to providing an electrical connection for high frequency currents, it also provides good electrical insulation for direct currents, a point of significance if the two walls 1 and 2 are at different direct potentials.

Moreover, the absence of any mechanical connection prevents the development of stresses which could arise due to distortions in the attenuator device or the walls to which it is fitted, and which could lead to cracking of the resistive body 6.

In one embodiment of an attenuator device such as that shown in FIG. 1, and in order that the effect of the energy-dissipating resistor R should, as already mentioned, predominate over that of the capacitors $C_1$ (in series with R) and $C_2$ (in parallel with R), the following values can for example be selected for walls 1 and 2 which are 25 mm apart.

By choosing the body 6 in such a way that the resistance R is 300 ohms, and assuming that the device is designed for example to attenuate waves of a frequency around 3000 MHz, an electrode 3 of thin design will be choosen and the device will be dimensioned in such a way that said electrode in 5 mm from the wall 1. The device can then support a direct voltage of several tens of kilovolts between the walls 1 and 2. Since the electrode 3 is around 20 mm far from the wall 2, the condition $C_1 \approx 4C_2$ will hold. Then, in order to achieve the impedance conditions referred to earlier, we can choose $(1/C_1\omega) = (R/2) = 150\Omega$, in other words $$C_1 = 0.35 \times 10^{-12} \text{ Farad and}$$
$$C_2 = 0.09 \times 10^{-12} \text{ Farad.}$$

The area of the electrode 3 will then be 2 $cm^2$. The resistive body 6 can have a length of 15 mm, a diameter of 8 mm and a resistivity of 100 ohm X cm. The device thus created will then absorb parasitic waves like a 450 ohm resistor connected directly between the walls 1 and 2.

Figure 2:
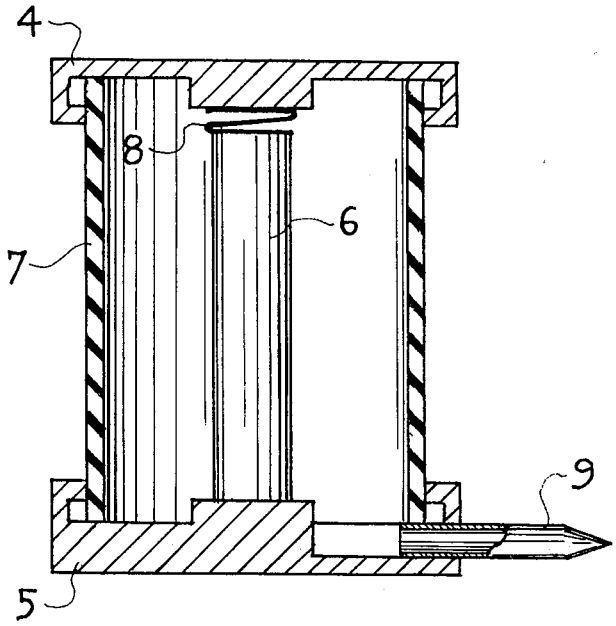
FIG. 2 illustrates a variant embodiment of the device shown in FIG. 1.

FIG. 2 illustrates a variant embodiment of the device in accordance with the invention comprising, in addition to the elements already described and marked by the same references, a flexible seal 8 which is also electrically conductive, connected between one end of the resistive body 6 and one of the mechanical components 4 or 5, here the component 4, making it possible to avoid mechanical stresses of the kind which could arise due to the differential expansions of the resistive body 6 and the insulating sheath 7. This variant embodiment also involves a pip 9 which makes it possible to evacuate the gastight enclosure in which the resistive body 6 is located or, if required, to fill it with a gas which prevents the development of a discharge. In this figure, neither the electrode 3 nor the walls 1 and 2 between which the device is mounted, have been shown.

Figure 3:
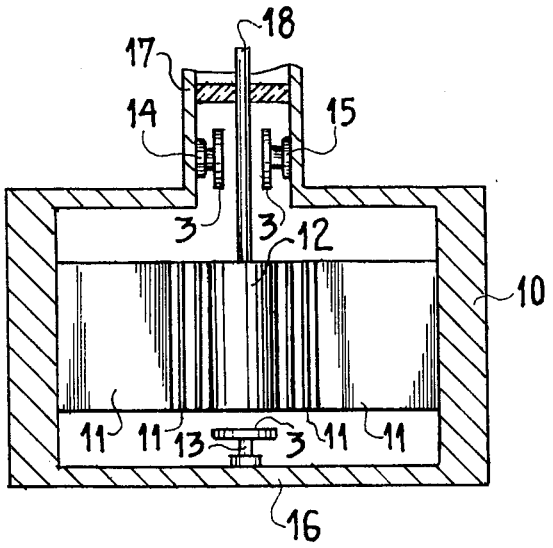
FIG. 3 is a schematic sectional view of a magnetron equipped with attenuator devices in accordance with the invention.
Figure 4:
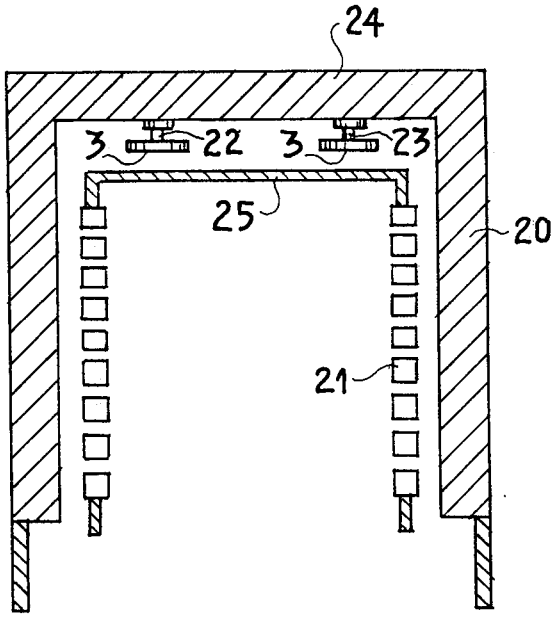
FIG. 4 is a highly schematic sectional view of part of a tetrode equipped with attenuator devices in accordance with the invention.

As already mentioned, the attenuator devices in accordance with the invention can be located in any region of the interior of a high frequency tube where an intense electric field between two conductive walls gives rise to parasitic high frequency waves which it is desired to suppress; it is clear that such devices are disposed in regions of said tubes where do not appear the useful high frequency waves of the tube because, as already mentioned, such devices being non selective, would provide a prejudical attenuation of useful power. FIGS. 3 and 4 illustrate highly schematically examples of magnetron and tetrode equipped with attenuator devices according to the invention.

FIG. 3 schematically illustrates in longitudinal section a magnetron whose anode comprises for example fins 11 arranged in the conventional way around a cylindrical cathode 12.

Parasitic wave attenuator devices in accordance with the invention can be arranged in the manner illustrated, either at 13 or at 14 and 15.

The attenuator device 13 is attached to the conductive wall 16 constituting the base (or anode support) of the magnetron, the capacitive electrode 3 being located opposite the corresponding end of the cathode.

The devices 14 and 15 are connected to the external conductor of the cathode lead so that their capacitive electrode 3 are opposite the internal conductor 18 of said lead. Here, it is possible to provide one, two or even more attenuator devices.

In FIG. 4 there have been schematically illustrated in longitudinal section the two last electrodes of a conventional tetrode, namely its anode 20 and its screen-grid 21. Parasitic wave attenuator devices in accordance with the invention are arranged, in the manner shown for example at 22 and 23, between the tio 24 of the anode 20 and that 25 of the screen-grid 21. One or more such devices can be provided, fixing them for example to the tip 24 of the anode 20, their capacitive electrode 3 being located opposite the top 25 of the screen-grid 21.

What is claimed is:

1. A device for attenuating very short parasitic waves occurring between two conductive walls of a high frequency electronic tube, comprising a resistive element connected between two conducting components, one of said two conducting components being connected to one of said two conductive walls and the other of said conducting components is located opposite the other of said conductive walls spaced therefrom and forms a capacitor in association therewith, said attenuator device being disposed between said two conductive walls in a region of said tube devoided of useful waves.

2. An attenuator device as claimed in claim 1, further comprising a gastight insulating sheath fixed between said two conducting components and providing a gastight enclosure around said resistive element.

3. An attenuator device as claimed in claim 2, further comprising means for providing communication with said gastight enclosure delimited around said resistive element by said insulating sheath.

4. An attenuator device as claimed in claim 3, wherein said gastight enclosure is exhausted.

5. An attenuator device as claimed in claim 3, wherein said gastight enclosure contains a gas for preventing the formation of electrical discharges whithin said enclosure.

6. An attenuator device as claimed in claim 1, wherein one end of said resistive element is attached to one of said conducting component by a flexible and conducting seal.

7. An attenuator device as claimed in claim 1 for attenuating very short parasitic waves occurring between two conductive walls of a magnetron, said attenuator device being disposed between a first wall forming the anode support of the magnetron and a second wall which is that end of the cathode located opposite said first wall.

8. An attenuator device as claimed in claim 1 for attenuating very short parasitic waves occurring between two conductive walls of a magnetron, said attenuator device being located in the region of the supplying lead of the cathode of the magnetron and between the external conductor and the internal conductor of said lead.

9. An attenuator device as claimed in claim 1 for attenuating very short parasitic waves occurring between two conductive walls of a high frequency tetrode, said attenuator device being arranged between the base of the anode of said tetrode and the facing base of the screen grid of said tetrode.

* * * * *